US006695655B2

(12) United States Patent
Washizu

(10) Patent No.: US 6,695,655 B2
(45) Date of Patent: Feb. 24, 2004

(54) TILT DEVICE FOR OUTBOARD DRIVE

(75) Inventor: Shoji Washizu, Kakegawa (JP)

(73) Assignee: Soqi Kabushiki Kaisha, Kakagawa (JP)

( * ) Notice: Subject to any disclaimer, the term of this patent is extended or adjusted under 35 U.S.C. 154(b) by 0 days.

(21) Appl. No.: 10/248,693

(22) Filed: Feb. 10, 2003

(65) Prior Publication Data

US 2003/0157847 A1 Aug. 21, 2003

(51) Int. Cl.[7] ..... B63H 21/26
(52) U.S. Cl. ..... 440/61 R
(58) Field of Search ..... 440/1, 2, 61 A, 440/61 F, 61 G, 61 R, 61 T

(56) References Cited

U.S. PATENT DOCUMENTS 3,722,455 A * 3/1973 Carpenter ..... 440/61 R
3,834,345 A * 9/1974 Hager et al. ..... 440/1
3,885,517 A * 5/1975 Borst et al. ..... 440/61 R
3,894,250 A * 7/1975 Hager et al. ..... 440/1
4,005,674 A * 2/1977 Davis ..... 440/1
4,391,592 A * 7/1983 Hundertmark ..... 440/61 R
4,605,375 A * 8/1986 Ferguson ..... 440/1
4,778,414 A * 10/1988 Taguchi ..... 440/1
4,824,407 A * 4/1989 Torigai et al. ..... 440/1
4,872,857 A * 10/1989 Newman et al. ..... 440/1
4,909,766 A * 3/1990 Taguchi ..... 440/61 R
4,990,111 A * 2/1991 Saitoh et al. ..... 440/61 R
5,007,866 A * 4/1991 Okita ..... 440/61 R
5,030,147 A * 7/1991 Binversie et al. ..... 440/61 R
6,048,234 A * 4/2000 Uematsu et al. ..... 440/1

* cited by examiner

*Primary Examiner*—S. Joseph Morano
*Assistant Examiner*—Lars A. Olson
(74) *Attorney, Agent, or Firm*—Ernest A. Beutler

(57) ABSTRACT

An improved tilt piston stroke control arrangement that employs a stroke control valve that controls the tilt stroke by closing a hydraulic conduit at a predetermined stroke position to thus shutting off the feed of hydraulic pressure to the tilt cylinder. Thus, the stroke control valve can be provided in any position in the associated hydraulic circuit. This increases the degree of freedom for layout and makes it possible to achieve a compact layout.

10 Claims, 7 Drawing Sheets

FIG. 5
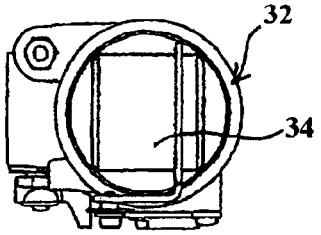
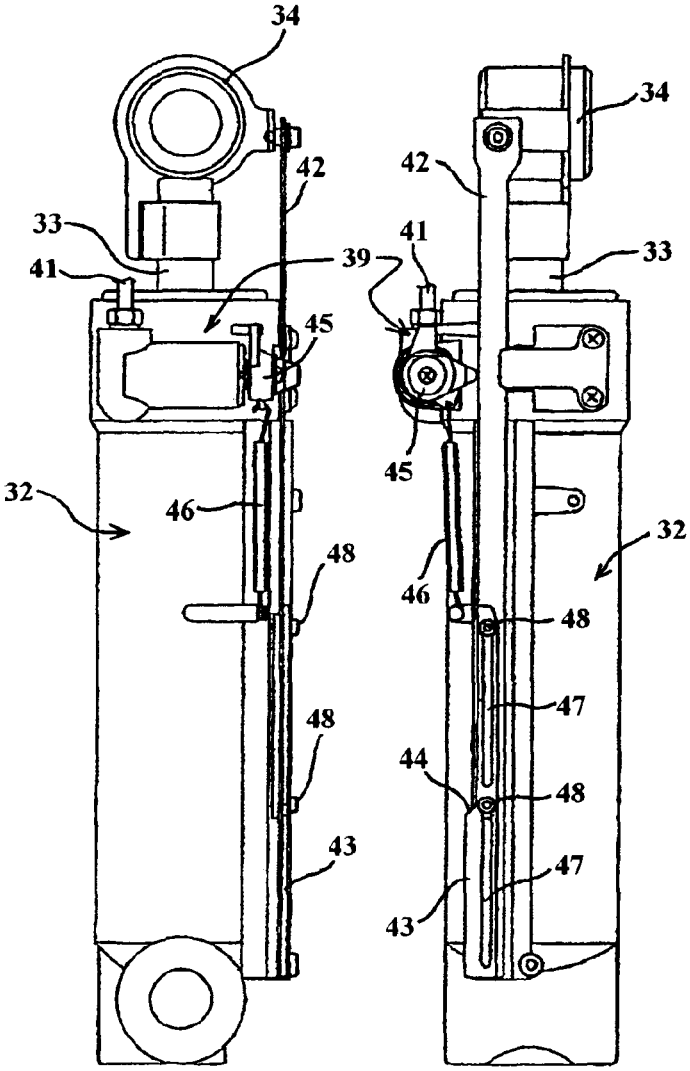
FIG. 4
FIG. 6

FIG. 9
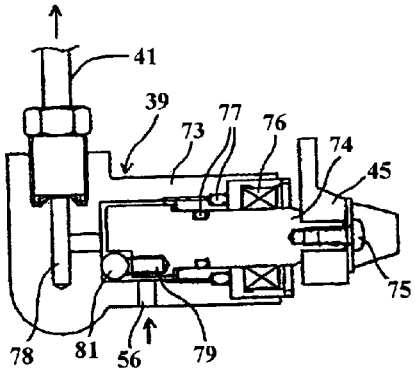
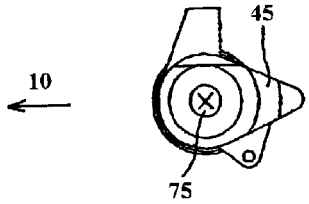
FIG. 10
FIG. 11
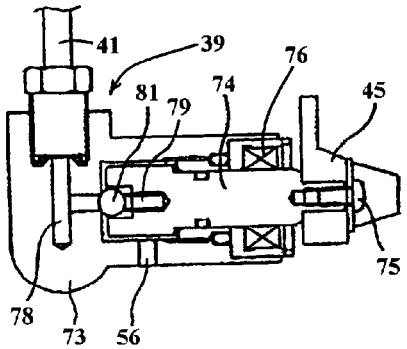
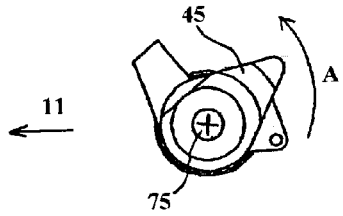
FIG. 12

TILT DEVICE FOR OUTBOARD DRIVE

BACKGROUND OF INVENTION

This invention relates to outboard drive arrangements for watercraft and more particularly to a tile device therefore.

As is well known, watercraft outboard drives, be they outboard motors or the outboard drive portion of a stern drive, normally include a hydraulically operated tile arrangement. This generally comprised a hydraulically operated cylinder pivotally connected to the outboard drive and the watercraft hull. By extending the cylinder, the propulsion unit of the outboard drive can be raised out of the water for servicing or trailering. Frequently these units also include a shock absorbing arrangement to permit the outboard drive to "pop up" when an underwater obstacle is encountered and then return when it is cleared. In addition, the tilt cylinder is incorporated in a unit that includes hydraulic trim cylinders that are utilized to adjust the trim angle of the propulsion unit during watercraft operation.

Due to the wide variety of types of outboard drives and types of watercraft that are powered by them, this presents a challenge to the manufacturers of the outboard drives and their customers. In order to keep costs as low as possible the number of different types of such units must be limited. However, the amount of tilt up must be controlled to prevent damage to either or both of the outboard drive and the associated watercraft.

One way this has been done is to employ an internal collar as a stopper for regulating the stroke of the tilt piston. This collar is conventionally attached at the upper limit position of the piston in the cylinder so that a stroke suitable for individual outboard drives or hulls can be obtained. However to accomplish this, the tilt device incorporating must be disassembled to fit a collar in the tilt cylinder. Also if it forms a part of a unit incorporating trim cylinders, the tilt cylinder must first be removed from them.

This disassembly and assembly frequently requires special tools and takes time and effort. Also, there is a possibility of foreign objects, which may cause failure, entering the cylinder during this adjusting operation.

Therefore, it is an object of the present invention to provide a tilt device for an outboard motor in which the stroke of the tilt cylinder can be easily adjusted without disassembling the tilt cylinder or removing it from another assembly.

SUMMARY OF INVENTION

This invention is adapted to be embodied in a tilt cylinder device for tilting an outboard drive between an underwater, driving position and an out of the water storage position. The tilt cylinder device comprises a cylinder assembly defining a cylinder bore. A piston reciprocates in the cylinder bore and divides it into two fluid chambers. A piston rod is affixed to the piston and extends through one of the fluid chambers and terminates externally of the cylinder assembly. The piston rod and the cylinder assembly each are pivotally connected to a respective one of an outboard drive and a watercraft for effecting the tilting of the outboard drive. A hydraulic circuit controls the operation of the tilt cylinder device. A tilt range control valve is provided for disabling the operation of the hydraulic circuit for selectively limiting the stroke of the piston.

BRIEF DESCRIPTION OF DRAWINGS

FIG. 4 is a side elevational view of the tilt-up device.

FIG. 5 is a top plan view of the tilt-up device.

FIG. 6 is a side elevational view of the side of the tilt-up device opposite to that shown in FIG. 4.

FIG. 9 is a cross sectional of the control valve of the present invention showing it in the OFF condition.

FIG. 10 is an end view looking in the direction of the arrow 10 in FIG. 9.

FIG. 11 is a cross sectional of the control valve, in part similar to FIG. 9 but showing it in the OFF condition.

FIG. 12 is an end view looking in the direction of the arrow 12 in FIG. 11.

DETAILED DESCRIPTION

Figure 1:
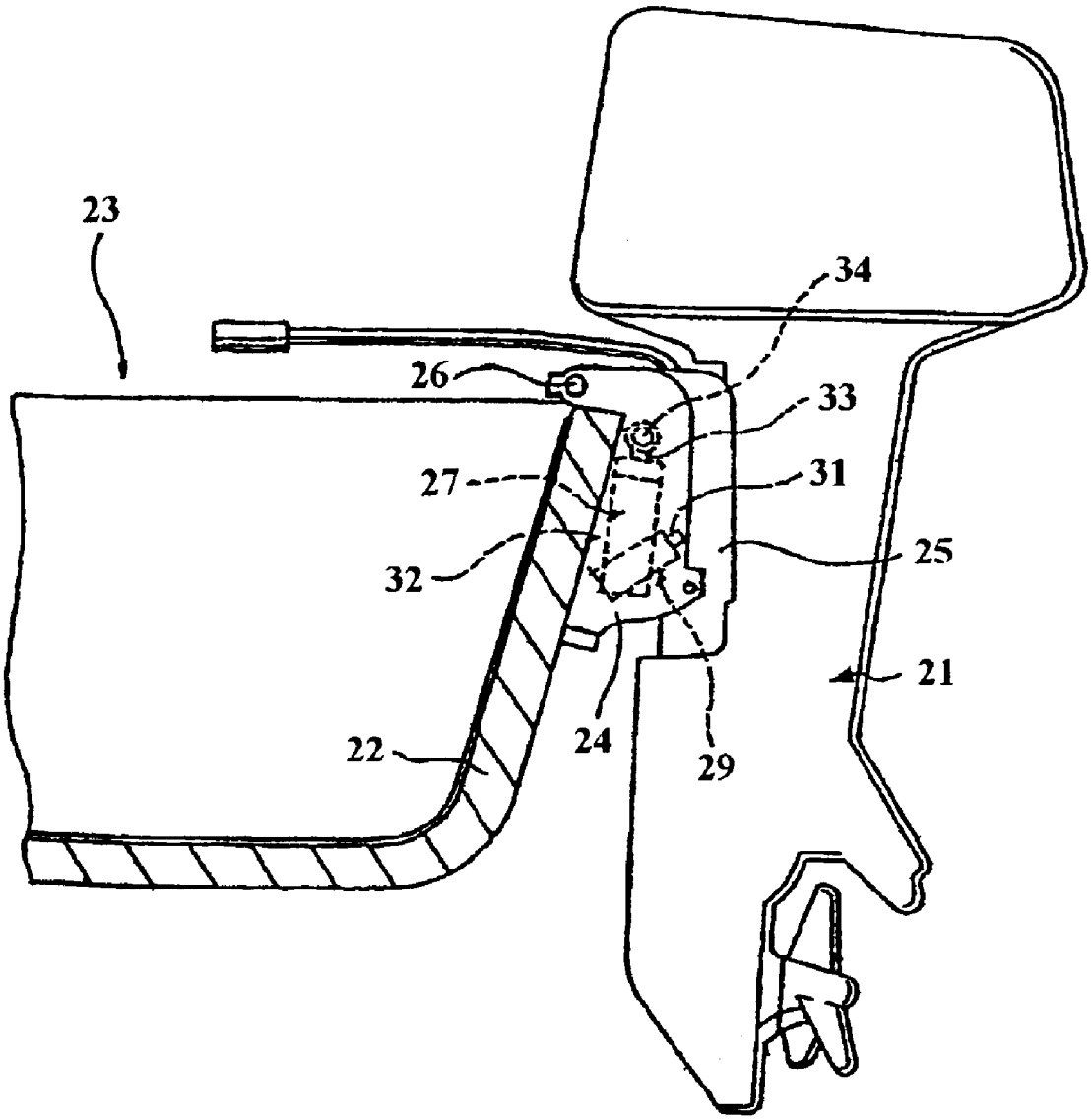
FIG. 1 is a side elevational view of an outboard motor to which the present invention is applied showing the outboard motor attached to the hull of an associated watercraft, shown partially and in cross section.

Referring now in detail to the drawings and initially to FIG. 1, an outboard motor, indicated generally by the reference numeral 21 is shown as attached to a transom 22 of a watercraft, indicated generally at 23 and shown partially and in cross section. Although in the illustrated embodiment the outboard drive comprises an outboard motor, it will be obvious to those skilled in the art that the invention may be used equally as well with the outboard drive of a stern drive.

The attachment is provided by a clamp bracket 24. The outboard motor 21 further includes a swivel bracket 25 is pivotally supported by the clamp bracket 24, for rotational movement about a horizontally disposed tilt pin 26. The outboard motor 21 is supported by the swivel bracket 25 for steering movement about a steering axis disposed approximately perpendicular to the tilt pin 26.

Referring now additionally and primarily to FIGS. 2–7, A tilt and trim unit 27 is attached to the clamp bracket 24. The tilt and trim unit 27 has a hydraulic driven tilt cylinder 32 at the center and hydraulically driven trim cylinders 29 directed obliquely rearwardly on both right and left sides of the tilt cylinder 32.

Each of the trim cylinders 29 has a cylinder bore in which a piston is reciprocally supported. Each piston has a rod 31 which abuts on the swivel bracket 25 and supports it. The extension and contraction of the rods 31 trim up and down the outboard motor 21 within an angular range (about 20°, for example). The hydraulic activation of these piston rods 31 will be described in more detail later by reference to FIG. 8.

The tilt and trim unit 27 also includes a tilt cylinder 32 defines a cylinder bore in which a piston, described later by reference to FIG. 8, which has a piston rod 33 connected to the swivel bracket 25 via a pivot pin 34. The extension and contraction of the rod 33 tilts up and down the outboard motor 21 within an angular range of about 70°, for example, considerably more than the trim range of the trim cylinders 29.

Referring now primarily to FIGS. 2–7, the tilt and trim unit 27 has a reversible electric motor 35 for driving a reversible oil pump 35 and an oil tank 37 positioned on opposite sides of an upper portion of the tilt cylinder 32. As has been previously noted, the fluid circuitry that communicate these components and the cylinders 27 and 29 will be described later by reference to FIG. 8. An electrical cable 38 supplies power to the reversible motor 35.

A tilt range control valve, indicated generally by the reference numeral 39, is located on the front side of the tilt cylinder 32. The construction of this tilt range control valve is shown in detail in FIGS. 9–12 and its operation will be described by reference to FIG. 8.

A hydraulic pipe 41 communicates the tilt range control valve with the hydraulic control circuit located in the housing of the pump 36. The hydraulic pipe 41 runs behind the tilt cylinder 32. Since the hydraulic pipe 41 runs behind the tilt cylinder 32, the tilt range control valve 39 can be disposed at a position which allows easy adjustment thereof on the front side of the tilt cylinder 32 in a compact manner without interfering with the hydraulic pipe 41. The function of the hydraulic pipe 41 will be described when referring to FIG. 8.

In the illustrated embodiment, the tilt range control valve 39 is operated by a mechanism, indicated generally at 40, comprised of a lifting bar 42, a driving piece 43 fixed at a lower end part of the lifting bar 42, a inclined step-like driving part 44 formed on one side of the driving piece 43.

The driving part 44 contacts and operates a switching lever 45 on which the driving part 44 abuts. A spring 46 constantly urges the switching lever 45 downward to an OFF state. The switching lever 45 is connected to the stroke control valve 37 and switches the stroke control valve 37 according to the stroke operation of the tilt piston rod 33.

The lifting bar 42 is secured to the pivot pin 34 at the upper end of the tilt piston rod 33 of the tilt cylinder 32 and moves up and down along with the stroke operation of the tilt piston rod 33.

The driving piece 43 has upper and lower slots 47 and is fixed to the lifting bar 42 by threaded fasteners 48 fitted in the slots 47, respectively. This permits the operating range of the tilt piston rod 33 to be adjusted with ease by changing the position of the driving piece 43.

As illustrated in FIGS. 2–6, the tilt piston rod 33 is contracted and the lifting bar 42 is in its lowermost position. The driving piece 43 has been separated from the switching lever 45, which is held in the OFF position by the spring 46.

Figure 7:
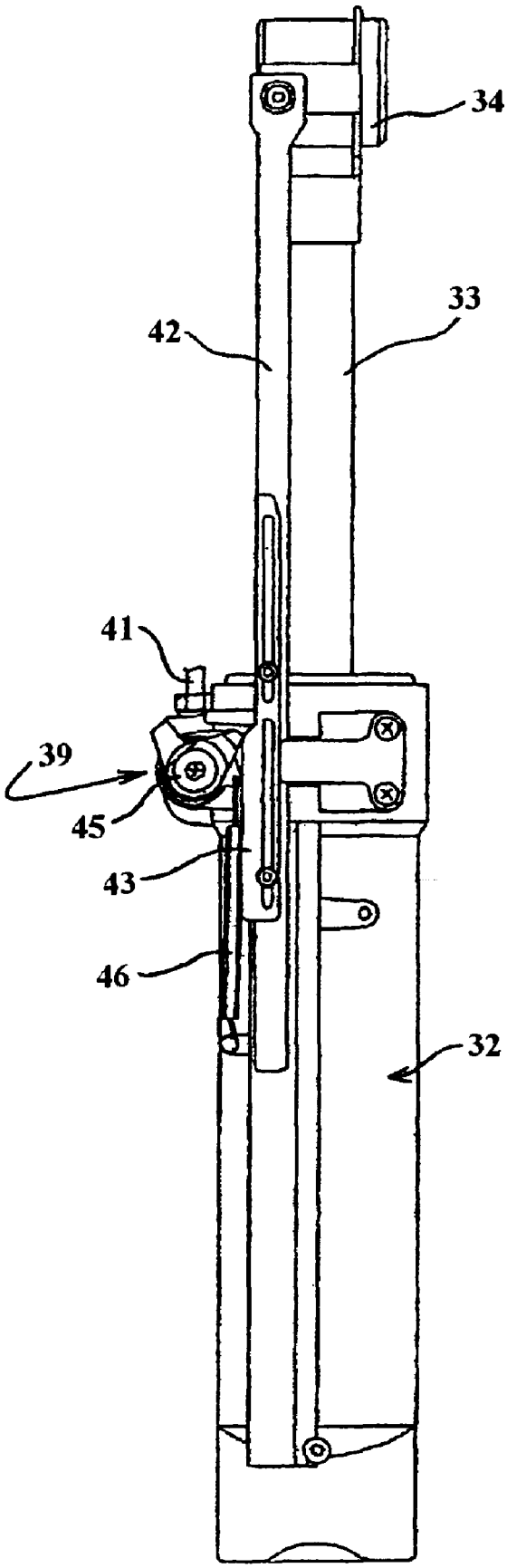
FIG. 7 is a side elevational view, in part similar to FIG. 6 but shows the device in a fully tilted up position as limited by the "On" condition of the tilt range control valve, which is shown in the "Off" position in the previous figures.

FIG. 7 illustrates the state where the rod 33 has been moved up and the switching lever 45 of the tilt range control valve 39 has been turned to ON (oil is shut off and the upward movement of the cylinder is stopped). Namely, from the state shown in FIG. 5, the rod 33 has been extended to move up the driving piece 43 together with the lifting bar 42, and the driving part 44 on one side of the driving piece 43 (see FIG. 4 and FIG. 5) has abutted on the switching lever 45 and pushed it up to the ON position against the spring 46.

Figure 8:
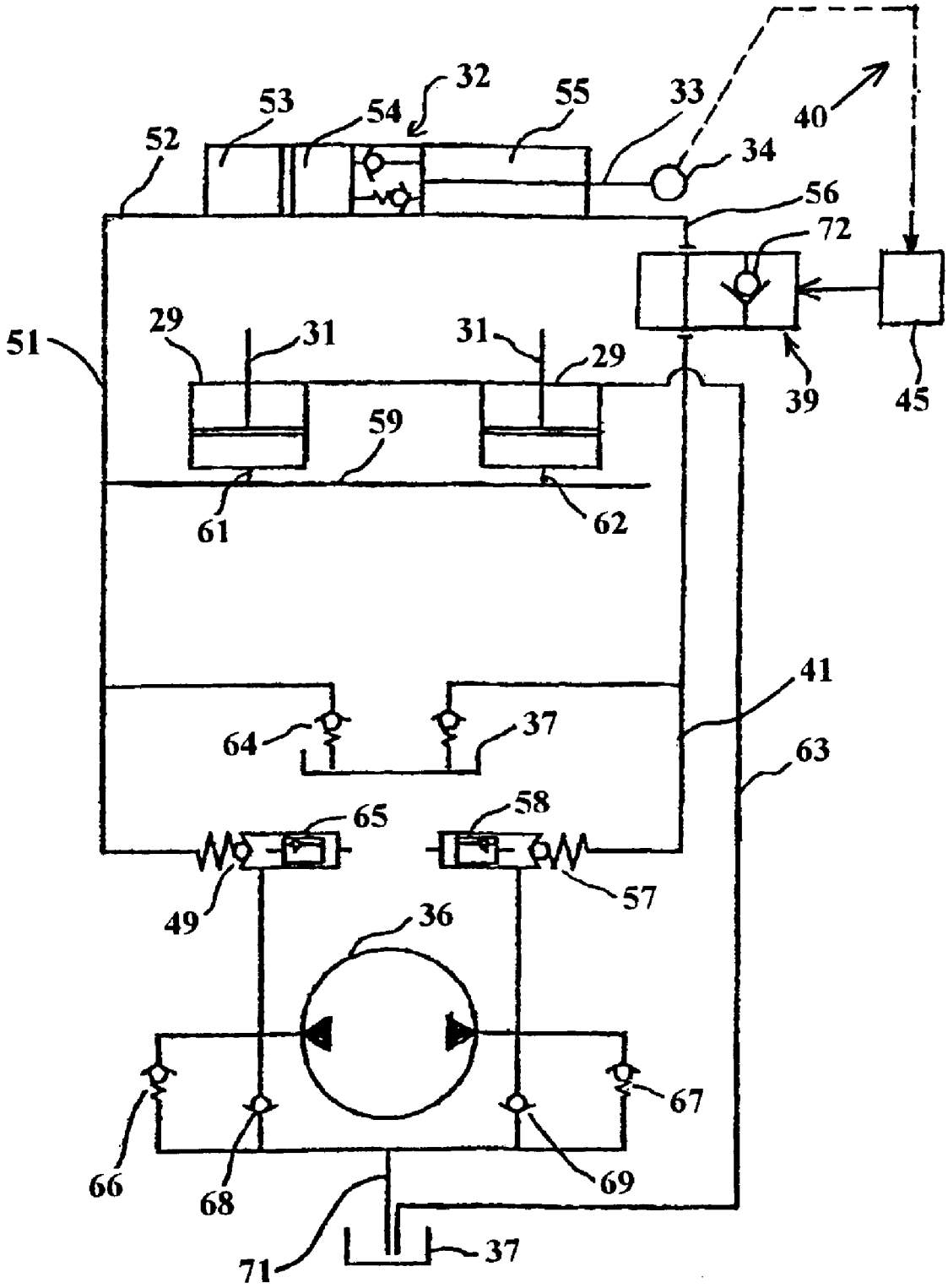
FIG. 8 is a hydraulic diagram of the present invention.

Referring now to FIG. 8, this is a hydraulic diagram of the trim and tilt device 27 as noted the reversible oil pump 36 is driven by the reversible DC motor 35 which does not appear in this figure. The oil pump 36 has a tilt and trim up delivery side connected through a first shuttle valve 49 to an hydraulic conduit 51 which is in turn connected to another hydraulic conduit 52. This supplies pressurized fluid to a tilt up chamber 53 of the tilt cylinder assembly.

This chamber 53 is formed below a floating memory piston 54 and a main piston 55 to which the piston rod 33 is affixed as aforenoted. The main piston 27 is provided with the normal absorber and let down valves to permit the outboard motor 21 to pop up to prevent damage when an obstacle is struck and return to the previous trim adjusted position when the obstacle is cleared. Since these valves are well known in the art, further description or illustration is not believed necessary for those skilled in the art to practice the invention.

Thus when the chamber 53 is pressurized, the rod 33 is pushed out and performs a tilt up operation. At this time, oil in an upper chamber 55, through which the rod 33 extends, is discharged through an internal passage 56 to the external conduit 41. The discharged fluid is returned to the oil pump 36 through the external conduit and a second shuttle valve 57. At this time, the main valve 57 has been opened by the action of a shuttle piston 58 in the main valve 57 which is operated by hydraulic pressure on the delivery side.

A hydraulic trim conduit 59 is branched off from the tilt trim up delivery side hydraulic conduit 51. Oil is pressure-fed to the trim cylinders 29 from the hydraulic conduit 59 through hydraulic conduits 61 and 62 and performs trim operation through the rods 31. Designated as reference numeral 63 is a return side hydraulic conduit from the trim cylinders 29 to the oil reservoir 37. As is well known in this art, the trim up operation is completed before tilt up operation is fully effected.

A manual valve 64 is provided between the delivery sides of the oil pump 36 to allow manual tilt operation. The manual valve 64 is communicated to the oil tank 37.

For tilt down operation, the rotational direction of the electric motor 35 and pump 36 are reversed to pressurize the line 56 through opening of the shuttle valve 57. The lines 51 and 52 then act as return lines to the pump 36 through opening of the shuttle valve 49 by a shuttle piston 65, as is well known in this art.

An up relief valve 66, a down relief valve 67 and one way valves 68 and 69 are also provided on the up and down delivery side of the oil pump 36. The up relief valve 66 and the down relief valve 67 return oil to the oil tank 37 according to the amount of oil in the lower chamber 53 or the upper chamber 55 in the tilt cylinder 32 when the pressure reaches a predetermined level or higher during tilt operation. The one way valves 68 and 69 feed oil to the delivery side from the oil tank 37 through a suction side hydraulic conduit 71 when the amount of oil in the lower chamber 53 or the upper chamber 55 in the tilt cylinder 32 becomes insufficient during tilt operation.

The manual valve 64, the main valves 49 and 57, the up relief valve 66, the down relief valve 67 and the one way valves 68 and 69 are integrally assembled with the oil pump 36 and disposed in the trim and tilt-up device 27.

When the tilt cylinder 32 has a large output, the trim cylinder may be omitted. In this case, the tilt cylinder 32 performs trim operation during running and functions as a combination tilt and trim cylinder.

In the hydraulic circuit of this embodiment, the stroke control valve 39 is a two-position switching valve comprising a check valve 72 and is switched between an open position (as shown) which allows the oil flow to pass therethrough and a closed position which stops the oil flow by the check valve 72. However when in this closed position tilt down is still possible as when the conduit 56 is pressurized the check valve 72 will open.

The tilt range control valve 39 is connected to the rod 33 of the tilt cylinder 32 or pivot pin 34 provided at the upper end thereof and switches the stroke control valve 39 at a predetermined stroke position according to the stroke operation of the piston rod 33. The stroke position at which the switching is performed can be adjusted from the outside the tilt-up device. When the tilt angle reaches a predetermined value during an upward stroke, the stroke control valve is closed to stop the oil flow, thereby the upward movement of the piston rod 33 of the tilt cylinder 32 being stopped. In this case, the downward movement of the piston rod 33 is not inhibited since oil is allowed to flow downward by the action of the check valve 72. Alternately, the stroke control valve 39 may be provided on the tilt up side of the tilt cylinder 32 (in the hydraulic conduit communicated to the lower chamber 53), not on the tilt down side thereof.

Referring now to FIGS. 9–12, the actual physical construction of the stroke control valve 39 will be described. FIGS. 9 and 10 illustrate the "Off" condition when the stroke of the tilt piston rod 33 is not limited. FIGS. 11 and 12 show the "On" condition when further tilt up is prevented. The tilt stroke control valve 39 is comprised of a housing member 73. This housing member 73 defines a cavity in which a rotary valve element 74 is journalled. The switching lever 45 is fixed to a protruding end of the rotary valve element 74 by a screw 75.

Figure 2:
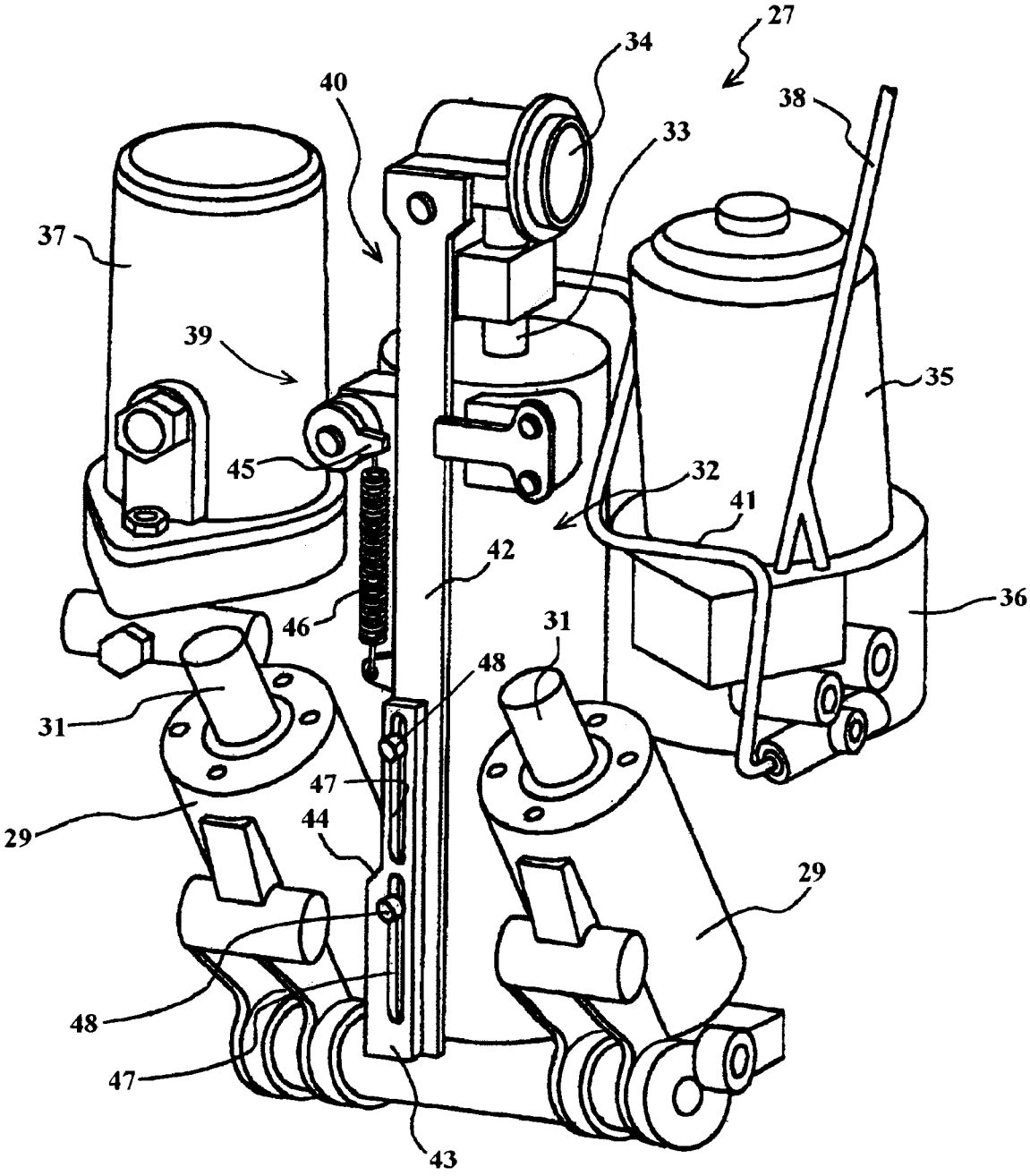
FIG. 2 is a front, perspective view of a tilt-up device of the present invention.
Figure 3:
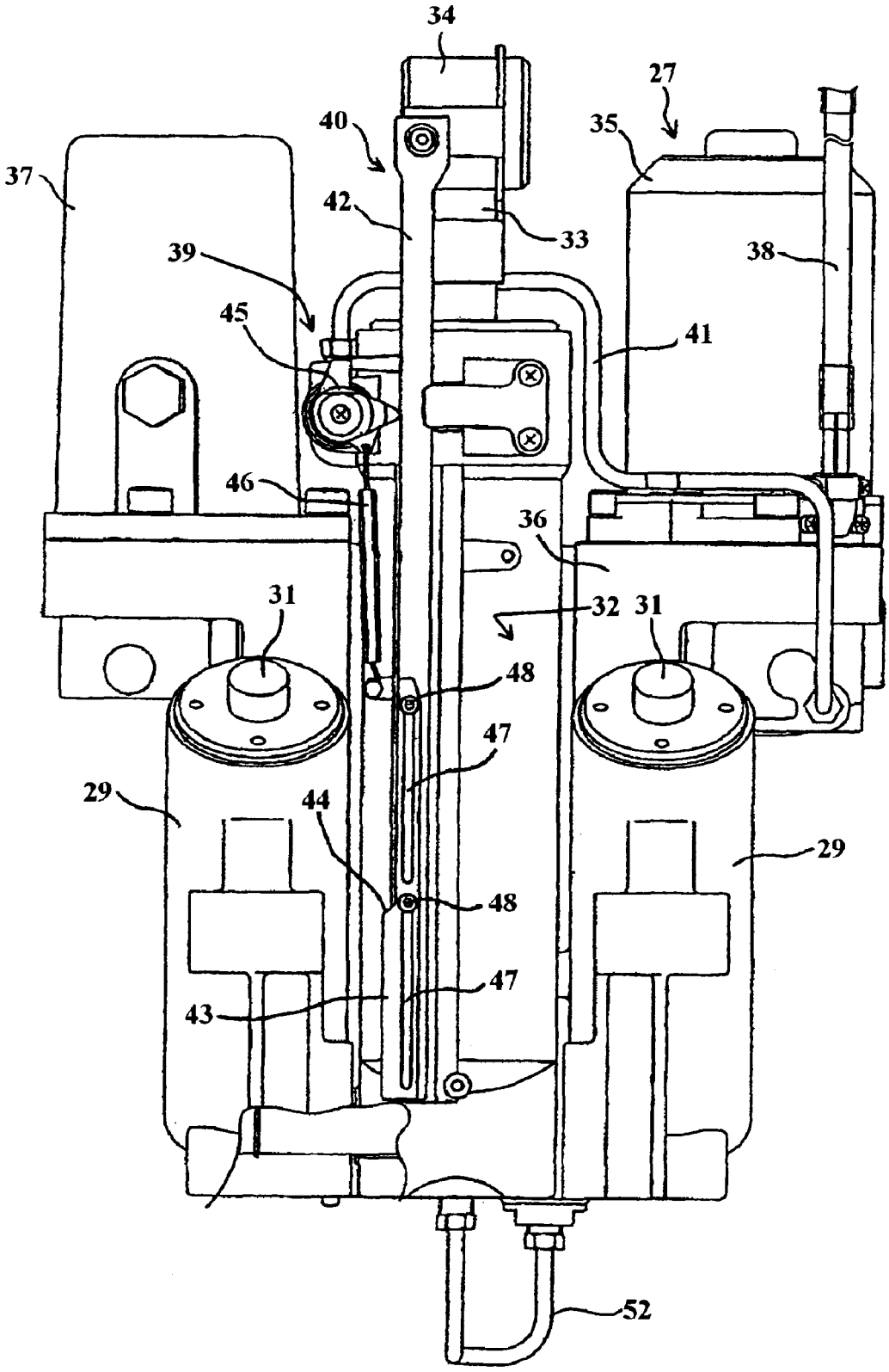
FIG. 3 is a front view of the tilt-up device.

The valve element 74 is journalled in the housing member 73 by a bearing 76. Seals 77 adjacent the bearing 76, prevent leakage from the valve chamber. A hydraulic conduit 78 is formed in the housing member 73 and serves as an oil outlet during an upward tilt stroke. The hydraulic conduit 78 is connected to the hydraulic pipe 41 on the side communicating with the oil pump 36. As previously noted the hydraulic pipe 41 runs behind the tilt cylinder 32 and is connected to the oil pump driven by the motor 35 (FIG. 2).

The valve element 74 is fitted opposite an opening of the oil passage 78. The passage 56 serves as an oil inlet during an upward stroke and is formed in the housing member 73 at a position corresponding to a side portion of the valve element 74. As previously noted, the passage 56 communicates with the piston rod chamber 55 of the tilt cylinder 32 (FIG. 8).

The valve element 74 has a spring 79 which presses a ball 81 against the opposite wall of the housing. The ball 81 constitutes the check valve previously identified as 72. In the "Off" condition shown in FIGS. 9 and 10, the ball 81 is in a position offset from the opening of the hydraulic conduit 78. In this state, oil discharged from the cylinder side flows in through the communication hole 56 as shown by the arrow, enters the hydraulic conduit 78 through a gap between the housing 73 and the valve element 74, and returns to the oil pump side though the hydraulic pipe 41. Thus, the oil flows freely and the tilt cylinder 32 can be operated either upward or downward.

As noted FIGS. 11 and 12, illustrate the state where the tilt stroke control valve 39 is "On". As described before, when the rod of the tilt cylinder is extended and the driving piece 44 abuts on the switching lever 45, the switching lever 45 is rotated as indicated by the arrow A. Then, the valve element 74 moves the ball 81 to close the opening of the hydraulic conduit 78 as shown in FIG. 11. Thereby, the oil flow from the communication hole 56 to the hydraulic conduit 78 is stopped. Thus, the upward movement of the tilt piston rod 33 is stopped.

However if tilt down movement is called for by reversing the pump 46, oil can flow from the hydraulic conduit 78 to the communication hole 56 by pushing the ball 81 back against the action of the spring 79. Thus, the downward movement of the tilt piston rod 33 is not inhibited.

As should be apparent from the foregoing description, the stroke control valve controls the tilt stroke by closing a hydraulic conduit at a predetermined stroke position to thus shutting off the feed of hydraulic pressure to the tilt cylinder. Thus, the stroke control valve can be provided in any position on the hydraulic circuit. This increases the degree of freedom for layout and makes it possible to achieve a compact layout. Also, this makes it possible to adjust the operative position of the stroke control valve easily from outside without disassembling the cylinder. Of course the foregoing description is that of a preferred embodiment of the invention. Those skilled in the art that various changes and modifications may be made without departing form the scope of the invention, as defined by the appended claims.

I claim:

1. A tilt cylinder device for tilting an outboard drive between an underwater, driving position and an out of the water storage position comprising a cylinder assembly defining a cylinder bore, a piston reciprocating in said cylinder bore and dividing it into two fluid chambers, a piston rod affixed to said piston and extending through one of said fluid chambers and terminating externally of said cylinder assembly, said piston rod and said cylinder assembly each being pivotally connected to a respective one of an outboard drive and a watercraft for effecting the tilting of the outboard drive, a hydraulic circuit for controlling the operation of said tilt cylinder device and a tilt range control valve for disabling the operation of said hydraulic circuit for selectively limiting the stroke of said piston.

2. A tilt cylinder device as set forth in claim 1 wherein the hydraulic circuit includes flow control valves positioned internally of said tilt cylinder device.

3. A tilt cylinder device as set forth in claim 2 wherein the tilt range control valve is positioned externally of said tilt cylinder device.

4. A tilt cylinder device as set forth in claim 3 wherein the tilt range control valve is disposed on the side of said tilt cylinder device facing the associated watercraft.

5. A tilt cylinder device as set forth in claim 4 wherein the tilt range control valve controls the flow through a conduit that extends along the side of said tilt cylinder device opposite to said tilt range control valve.

6. A tilt cylinder device as set forth in claim 2 wherein the hydraulic circuit for controlling the operation of said tilt cylinder device comprises a pair of shuttle valves each of which selectively controls either the pressurization or exhaustion of fluid for a respective one of the fluid chambers of said tilt cylinder device.

7. A tilt cylinder device as set forth in claim 6 wherein the tilt range control valve is disposed in a circuit connecting one of said shuttle valves and its served fluid chamber.

8. A tilt cylinder device as set forth in claim 7 wherein the tilt range control valve includes a check valve for permitting flow from the served fluid chamber for permitting the outboard drive to be tilted down even when the tilt position is being limited by said tilt range control valve.

9. A tilt cylinder device as set forth in claim 8 wherein the tilt range control valve is manually operable.

10. A tilt cylinder device as set forth in claim 8 wherein the tilt range control valve is operated in response to the position of the piston rod relative to the cylinder assembly.

* * * * *